United States Patent [19]

Court

[11] Patent Number: 5,052,493

[45] Date of Patent: Oct. 1, 1991

[54] FIRE SUPPRESSION SYSTEMS FOR VEHICLES

[75] Inventor: Anthony J. T. Court, Filton, United Kingdom

[73] Assignee: British Aerospace PLC, London, United Kingdom

[21] Appl. No.: 528,545

[22] Filed: May 25, 1990

[30] Foreign Application Priority Data

May 27, 1989 [GB] United Kingdom ..... 8912273

[51] Int. Cl.[5] ..... A62C 35/12

[52] U.S. Cl. ..... 169/9; 169/37; 169/62

[58] Field of Search ..... 169/54, 62, 5, 9, 11, 169/14, 16, 37; 244/129.2, 118.5

[56] References Cited

U.S. PATENT DOCUMENTS

| | | | |
|---|---|---|---|
| 1,918,191 | 7/1933 | Paulus . | |
| 2,557,120 | 6/1951 | Knoblock . | |
| 2,557,162 | 6/1951 | Wetzel . | |
| 3,465,827 | 9/1969 | Levy et al. | 169/62 |
| 4,151,882 | 5/1979 | Baker et al. | 169/9 |
| 4,224,994 | 9/1980 | Tone et al. | 169/9 |
| 4,347,901 | 9/1982 | Wilhoit | 169/62 |
| 4,596,289 | 6/1986 | Johnson | 169/37 |

FOREIGN PATENT DOCUMENTS

| | | | |
|---|---|---|---|
| 1420749 | 11/1965 | France . | |
| 395994 | 7/1933 | United Kingdom . | |
| 2146243A | 4/1985 | United Kingdom . | |
| 2217668 | 11/1989 | United Kingdom | 169/62 |

*Primary Examiner*—Sherman Basinger
*Assistant Examiner*—Stephen P. Avila
*Attorney, Agent, or Firm*—Kerkam, Stowell, Kondracki & Clarke

[57] ABSTRACT

A fire and smoke suppression system suitable for passenger aircraft capable of 'surviving' a crash consists of a plurality of individually and independently operable unit (17) each including its own self-contained supply of fire/smoke suppressant, such as water, as well as its own self-contained supply of a pressurizing device, such as $CO_2$ bottle (23) which, on activation, expels the suppressant under pressure. Each unit (17) is an integrated assembly including a spray head (18) terminating in a nozzle (20) in flow communication with a flexible bag tank (25) containing water and accommodated in a rigid outer shell (24).

7 Claims, 1 Drawing Sheet

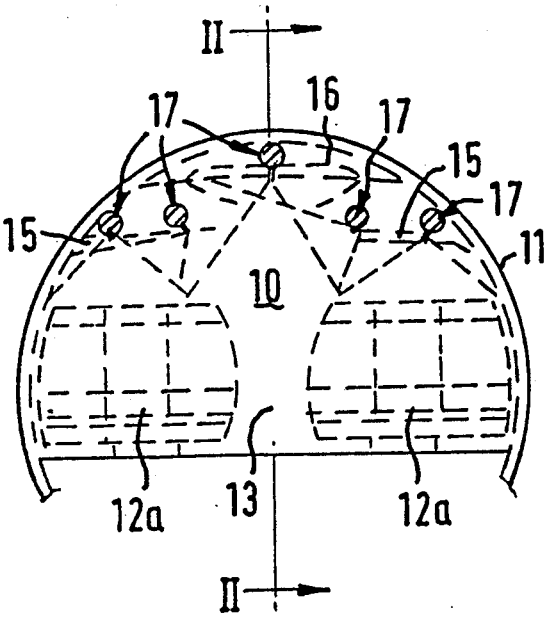
FIG.1
FIG.2
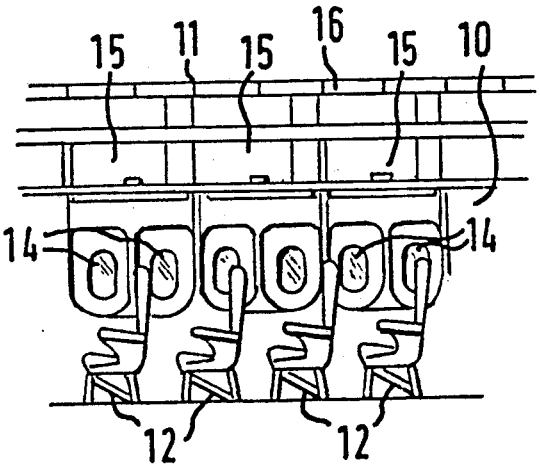
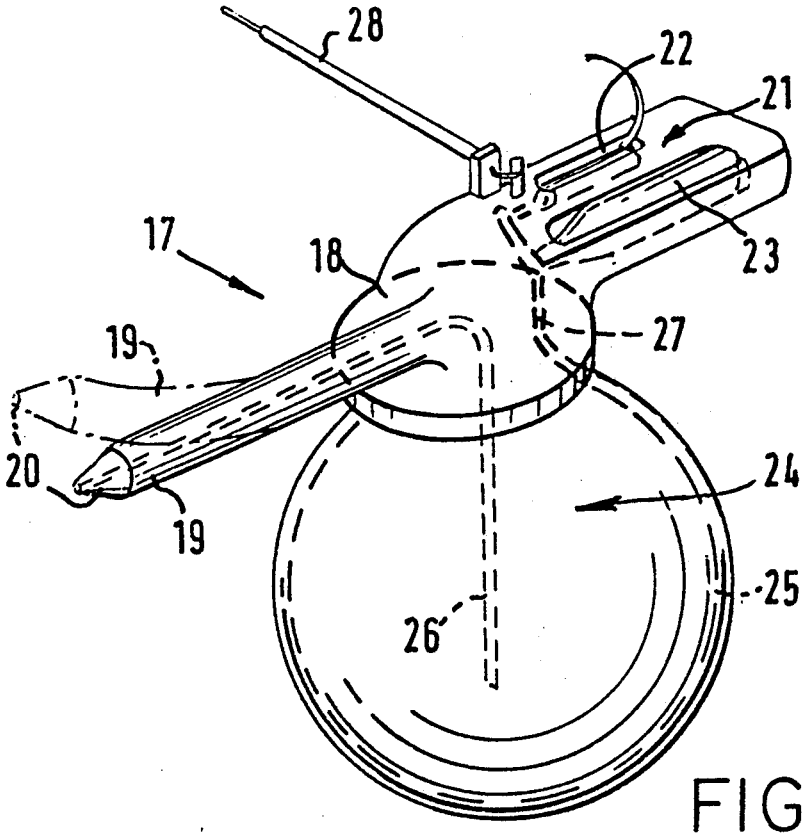
FIG. 3

FIRE SUPPRESSION SYSTEMS FOR VEHICLES

This invention relates to fire suppression systems for vehicles. Although described specifically in the context of an aircraft installation it is equally relevant to other means of transport operating on land or at sea.

The urgent need to provide on-board fire suppression systems has been recognised in order to reduce or eliminate, as far as possible, the incidence of death or serious injury arising from a catastrophic incident involving passenger-carrying transport. An airliner is a particularly relevant example and there are well-known examples where passengers, having survived the crash comparatively unharmed, have subsequently succumbed to the effects of fire, heat, smoke or toxic gas inhalation arising as a result of the fire. Thus, it is a known fact, from the Manchester disaster experience for example, that the most lethal aspects of an aircraft fire are toxic smoke and high temperatures.

There have been numerous proposals for on-board fire suppression systems generally comprising a number of spray nozzles dispersed at selected locations through the passenger cabin and connected via a piping network to a water supply. The system may draw on a dedicated supply of water or on one that is available for normal on-board services, is retained on-board for the duration of the flight and which could be recirculated, if necessary.

Experimentation has shown that in the post-crash phase, the first three minutes are critical in suppressing flame and smoke and thus the on-board supply must be adequate to meet that requirement without being supplemented by an outside source, even if that is feasible, since the crash site may be remote or not readily accessible.

These proposed systems have numerous disadvantages not least of which is the possibility of break-up of the aircraft on impact or sufficient structural damage to cause consequential damage to the piping network with interruption of the flow. A further shortcoming is that to fit such a system retrospectively to in-service aircraft can be difficult and costly with a significant weight penalty.

Thus, GB-A-2,146,243 discloses a fire detection and suppression system which includes a plurality of individual fire detection and suppression units each of which has its own source of fire suppressor in the form of a bottle of 'Halon' (Trade Mark), which can be discharged from the bottle under pressure by an electrical signal. The units are under the control of a master control station in a highly elaborate system, designed for ships. Essentially, such a system is not suitable for incorporation into or being carried by aircraft because the system would be highly vulnerable to destruction or inoperability in situations of very high mechanical shocks such as occur on aircraft crash and subsequently break-up.

GB-A-395,994 discloses a fire extinguisher for (land) motor vehicles, in which an outer rigid vessel for emitting pressurised fluid contained in a flexible bag within the vessel, discharge of the pressurised fluid occurring when compressed air is passed into the outer vessel so as to collapse the flexible gas. However, the source of compressed air suggested there is a separate source such as the tyre of the vehicle. In an emergency, there simply is not the time to establish the necessary connections while the 'automatic action' version suggested in this 1933 publication could not be expected, let alone guaranteed, to survive intact in the event of a major impact or crash.

The present invention seeks to overcome, or at least greatly to mitigate, the disadvantages of known fire extinguishing means for aircraft use by providing apparatus, as well as a method of its operation, with a very high degree of chance of 'survival' in the event of a crash, wherein each of a plurality of independently operable individual fire extinguisher units has its own source of fire and smoke suppressant, e.g. water, as well as its own source of pressurised air, e.g. a carbon dioxide cartridge or bottle such as is standard with normal lifejacket cylinders already carried by aircraft and which would be virtually indestructible due to its shape and size. The purpose of, and benefit arising from, the use of water is two-fold; it knocks down the toxic smoke and it cools the temperatures as well as extinguishing the fire. In practice, survival is very much determined by smoke and temperature rather than the actual fire. The use of 'Halon' as an effective extinguishant requires that it must be absolutely correct in composition and dispersion in order to make it breathable. A wrong balance can, in fact, add to the toxic fume hazard.

It is one object of the present invention to provide a fire suppression system for passenger carrying transport in which each spray nozzle includes its own self-contained supply of suppressant and includes means for selectively activating each of said spray nozzles.

It is a further object of the present invention to provide a spray nozzle assembly for a fire suppression system including self-contained suppressant and activating means.

According to one aspect of the present invention there is provided a fire and smoke suppression system for a vehicle, e.g. a passenger aircraft, said system comprising a plurality of suppressant fluid spray nozzle assemblies disposed at preselected locations within said vehicle, each of said spray nozzle assemblies including at least one spray nozzle, a self-contained supply of suppressant fluid, a self-contained supply of fluid presurizing means and system activating means, the arrangement being such that, when activated, said supply of fluid pressurizing means causes said suppressant fluid to be discharged as a dense mist or spray from said spray nozzle means under substantially constant pressure such that, in combination, the output of the plurality of spray nozzles defines a fire and smoke suppressing blanket for a critical time period for vehicle evacuation.

According to another aspect of the present invention there is provided a spray nozzle assembly for a fire and smoke suppression system of a vehicle, e.g. a passenger aircraft, said assembly comprising at least one spray nozzle head, a self-contained supply of suppressant fluid, a self-contained supply of fluid pressurizing means, and system activating means the arrangement being such that when activated by said activating means said suppressant fluid is pressurized and discharged from said spray nozzle means as a mist or spray at substantially constant pressure.

One embodiment of the invention will now be described, by way of example only, and with reference to the accompanying drawing in which:

FIG. 1 is an end elevation on an aircraft passenger cabin,

FIG. 2 is a longitudinal sectional side elevation on a portion of aircraft passenger cabin taken along a line II—II in FIG. 1, and FIG. 3 illustrates one typical embodiment of a spray nozzle assembly in accordance with the invention.

Referring to the drawing, FIGS. 1 and 2 illustrate a portion of aircraft passenger cabin 10 in a fuselage 11 and which includes rows of passenger seats 12 spaced longitudinally with respect to each other along the cabin. In this arrangement each row comprises a triple seat unit assembly 12*a* disposed to each side of the aircraft to provide a gangway 13. The fuselage includes cabin windows 14 in well-known manner. Positioned above the seat rows are longitudinally extending overhead stowage bins 15 and also included lengthwise along the cabin is a head-lining panel 16.

Positioned at suitable pre-defined locations throughout the cabin length are individual spray nozzle assemblies 17 and, as indicated in FIG. 1, they may be located within the area of the headlining or stowage bins but in such a way that the spray nozzle will provide the most effective dispersion into the cabin space, preferably as a mist. Each spray nozzle assembly 17 comprises a spray head 18 incorporating an elongated portion 19 terminating in a spray nozzle 20 which is not dimensionally disclosed herein. The elongated portion 19 may be rigid as an integral extension of the spray head 18 or it may be a separate, flexible (as shown by the broken lines) component located to the head 18. The spray head 18 further incorporates its own integral activating means 21 comprising a cartridge 22 communicating with a 'one-shot' compressed $CO_2$ bottle 23, thus constituting a self-contained, virtually indestructible supply of fluid pressurizing means. Such 'one-shot' $CO_2$ bottles are carried as standard for use in inflating life jackets. A spherical outer shell 24 mounted beneath the spray head 18 incorporates a flexible spherical bag tank 25 of silicon rubber or similar material for containing the suppressant water or other suitable fluid. A feed tube 26 connects the bag tank with the spray nozzle 20. The $CO_2$ bottle 23 discharges through a pressure regulator (not shown) so that by means of a delivery tube 27 the space between the outer shell 24 and the bag tank 25 can be pressurized to expel the suppressant at the desired pressure. The cartridge 22 is actuated by suitable electrical means, by the flight or cabin crew when required, but alternatively the assembly can beneficially incorporate a mechanical link by means of a spring-loaded Bowden cable 28. These actuating arrangements are not discussed in detail here but the mechanical arrangement will interconnect a series of the spray nozzle assemblies to ensure simultaneous operation for maximum effect. In the event that electrical actuation is not possible due perhaps to some malfunction arising from the crash, the mechanical arrangement can include suitable lever means or a guillotine for severing the spring-loaded cables subject, of course, to the arrangement both electrical and mechanical incorporating safeguard devices against inadvertent actuation.

To sustain the recommended flow rates for 3 minutes, each nozzle has to be capable of delivering 5 pints of water (=180 cu. ins=2950 $cm^3$) at 40 psi (=275.8 kPa) requiring a spherical tank of some 7" (=17.8 cm) diameter and the commercially available compressed $CO_2$ bottle 23 discharging through a regulator will maintain an outlet pressure of 40 psi (=275.8 kPa) for the desired time.

Numerous benefits over the prior art systems exist. For example:

a) since each spray nozzle assembly incorporates its self-contained fluid supply within the pressurized bag tank it will continue to operate even where the aircraft has not settled in an horizontal attitude, b) there is no reliance on a central supply of water, c) it can be easily installed retrospectively, d) the spherical outer shell 24 and the bag tank 25 need not be spherical and can be adapted to make use of available space within the cabin, e) unlike known proposals where primed piped systems can only be tested with difficulty, in the present invention a proportion of spray nozzle assemblies can be changed at regular time intervals and returned to base workshops for testing, and f) each unit carries its own virtually indestructible supply of $CO_2$.

I claim:

1. An aircraft fire and smoke suppression system, said system comprising a plurality of suppressant fluid spray nozzle assemblies (17) disposed at pre-selected locations within the same enclosure of said aircraft, each of said spray nozzle assemblies (17) including:

its own spray nozzle (20);

its own self-contained supply (25) of suppressant fluid;

its own self-contained supply (23) of fluid pressurizing means; and co-ordinatable system activating means (22; 28) capable of activating each said assembly (17) selectably independently of each other said assembly (17) and simultaneously with at least some of the other said assemblies (17);

the arrangement being such that, when activated, each said individual supply (23) of fluid pressurizing means causes said suppressant fluid to be discharged within said enclosure as a dense mist or spray from said spray nozzle(s) (20) under substantially constant pressure such that, in combination, the output of the plurality of spray nozzles (20) defines a fire- and smoke-suppressing blanket for a critical time period for evacuation of the aircraft.

2. The invention according to claim 1 wherein said suppressant fluid is contained within a tank (25) connected to said fluid pressurizing means supply (23) and to said spray nozzle assembly (17).

3. The invention according to claim 1, wherein said suppressant fluid is water.

4. The invention according to claim 1, wherein said tank (25) is a flexible bag contained within a storage tank (24), said flexible bag (25) being connected to said spray nozzle head (18) and the storage tank (24) is connected to said pressurizing means supply (23) such that when activated the space between the wall(s) of said storage tank (24) and said flexible bag (25) is pressurized by said pressurizing means supply (23) to apply a constant discharging pressure on said suppressant fluid.

5. The invention according to claim 1, wherein said self-contained supply of pressurizing means comprises a 'one-shot' compressed $CO_2$ bottle (23) or cartridge.

6. The invention according to claim 1, wherein said activating means comprises at least one of: electrical signalling means and mechanical actuation means (28).

7. An aircraft fire and smoke suppression system comprising a plurality of water spray nozzle assemblies (17) disposed at preselected locations within a single enclosure of the said aircraft, each of said assemblies (17) including:

a storage tank (24);

a flexible bag (25) contained in the storage tank (24) and permanently containing water;

a spray nozzle head (18) having an outlet communicating with said enclosure;

a connecting duct (26) connecting the interior of the flexible bag (25) with the spray nozzle head (18);

a one-shot container (23) of compressed gas for pressurizing the flexible bag (25);

a delivery tube (27) for delivering compressed gas from said one-shot container (23) to the interior of the flexible bag (25); and system activating means (22; 28) effective selectably to activate one of: any selected one, and any selected group, of said water spray nozzle assemblies (17), the arrangement being such that in the event of fire within the said enclosure the system remains readily activated such that the selected water spray nozzle assembly(ies) (17) will discharge a dense spray of water at substantially constant pressure to knock down toxic smoke and cool the temperature within said enclosure for a sufficient time to evacuate persons in said enclosure.

* * * * *